United States Patent [19]

Bonin

[11] Patent Number: 4,658,793

[45] Date of Patent: Apr. 21, 1987

[54] FUEL INJECTION PUMPS FOR INTERNAL COMBUSTION ENGINES

[75] Inventor: Jean-Claude Bonin, Blois, France

[73] Assignee: Lucas Industries public limited company, Birmingham, England

[21] Appl. No.: 773,125

[22] Filed: Sep. 6, 1985

[30] Foreign Application Priority Data

Sep. 6, 1984 [FR] France ..... 84 13710

[51] Int. Cl.[4] ..... F02M 59/20

[52] U.S. Cl. ..... 123/502; 123/501

[58] Field of Search ..... 123/501, 502

[56] References Cited

U.S. PATENT DOCUMENTS 4,041,919 8/1977 Bonin ..... 123/502
4,408,590 10/1983 Bonin ..... 123/502
4,422,428 12/1983 Eheim ..... 123/502

FOREIGN PATENT DOCUMENTS 69426 6/1981 Japan ..... 123/502

*Primary Examiner*—Tony M. Argenbright

[57] ABSTRACT

A fuel injection pump for an internal combustion engine is of the rotary distributor type and has a high pressure pump which includes a cam ring which is angularly adjustable by means of a piston to vary the timing of fuel delivery. The piston is biased to a position suitable for starting the engine by a first spring, the first spring being located between the piston and a collar. The latter is biased by a second preloaded spring against which the piston can move after the clearance between the piston and collar has been taken up. An electromagnetic device includes an armature core which can exert a thrust on the piston but which in the absence of fluid pressure is unable to move the piston against the springs. When fluid pressure is applied to the piston the combined forces acting on the piston are sufficient to move the piston to the limit of movement of the armature core to compress the first spring and also partly to compress the second spring.

5 Claims, 8 Drawing Figures

16
15
17
14
11
10
1
12
13
7
9
2
8
3
6
5
4

FUEL INJECTION PUMPS FOR INTERNAL COMBUSTION ENGINES

The present invention relates to a fuel injection pump of the rotary distributor type for supplying fuel to internal combustion engines, and in particular compression ignition engines.

Injection pumps of the rotary distributor type include a high pressure pump which is actuated in timed relationship with the associated engine and a distributor rotor which rotates in a fixed body and which distributes fuel delivered by the high pressure pump to outlet ports in turn. The high pressure pump includes a component which is adjustable to enable the timing of fuel delivery by the injection pump to be varied.

In a known form of injection pump the component comprises a cam ring which has cam lobes engageable with cam followers located at the ends of the plungers which in this case are mounted in a bore or bores in the distributor rotor. Also in this form of pump the cam ring is coupled to a piston, which piston is subject to the action of a fluid pressure and to the action in the opposite direction of a return spring supported on the pump body.

This arrangement is normally used to vary the beginning of injection as a function of the speed of the engine, the pressure acting on the piston varying as a function of the engine speed.

However, the positioning of the ring solely as a function of the engine speed does not enable the achievement of satisfactory operation of the engine as it is often necessary to regulate the beginning of injection as a function of other parameters. For example, at low speeds, it is generally necessary to bring the beginning of injection forward when the engine is cold, or during the running-in period. In some cases it is necessary to modify the start of injection of fuel as a function of the load applied to the engine.

This implies that it is necessary to be able to modify the position of the ring independently of the rotation speed parameter alone.

French Patent Specification No. 2365027 discloses a pump in which the initial position of the piston connected to the ring may be displaced so as to bring the beginning of injection forward. However, a device of this type has the drawback that when the piston has been displaced in this way, the beginning of injection is brought forward over the entire range of low speeds, i.e. from zero speed to the speed corresponding to a pressure sufficient to overcome the force of the return spring.

This system is therefore incompatible with the requirement for a specific beginning of injection at the time of starting, and in particular with devices of the automatic start delay type as set out in French Patent Specification No. 2299514 which require the piston to be free and able to occupy different positions as a function of various parameters.

French Patent Specification No. 2450352 describes a construction providing the characteristics set out above. This construction has the drawback that it only provides mechanical solutions which are easy to carry out manually, but difficult to automate.

The object of the invention is to provide an injection pump in which the beginning of delivery of fuel to an engine at low engine speeds may be varied without modifying the beginning of delivery of fuel during starting of the engine.

According to the invention a fuel injection pump for supplying fuel to an internal combustion engine in particular a compression ignition engine, comprises a high pressure pump which is actuated in timed relationship in use, with the associated engine, a distributor rotor which rotates in a fixed body and which distributes fuel delivered by the high pressure pump to outlets in turn, the outlets in use being connected to the injection nozzles of the engine respectively, a component in the high pressure pump which is adjustable to vary the timing of delivery of fuel, a fluid pressure operable piston, means coupling said piston to said component, means for supplying to one end of said piston a fluid control pressure which varies in accordance with an engine operating parameter, a first compression spring acting between the other end of said piston and a collar, a stop for the collar and a second compression spring acting to urge said collar into contact with said stop, whereby as the control pressure increases, the piston will move firstly against the action of said first spring through a predetermined distance until the piston engages said collar and after a further increase in the control pressure will move against the action of said second spring, characterised by an electromagnetic device including a core which when electric current is supplied to the device imparts a thrust on said one end of the piston in opposition to the force exerted by said springs, the working stroke of said core being greater than said predetermined distance, the characteristics of said device being such that in the absence of said fluid control pressure the core is unable to move the piston against the action of said first spring but when the fluid control pressure rises to a value at which movement of the piston against the action of the first spring can occur, the combined action of the fluid control pressure and the thrust exerted by the core moves the piston through a distance represented by the working stroke of the core.

An example of an injection pump in accordance with the invention will now be described with reference to the attached drawings, in which.

Figure 1:
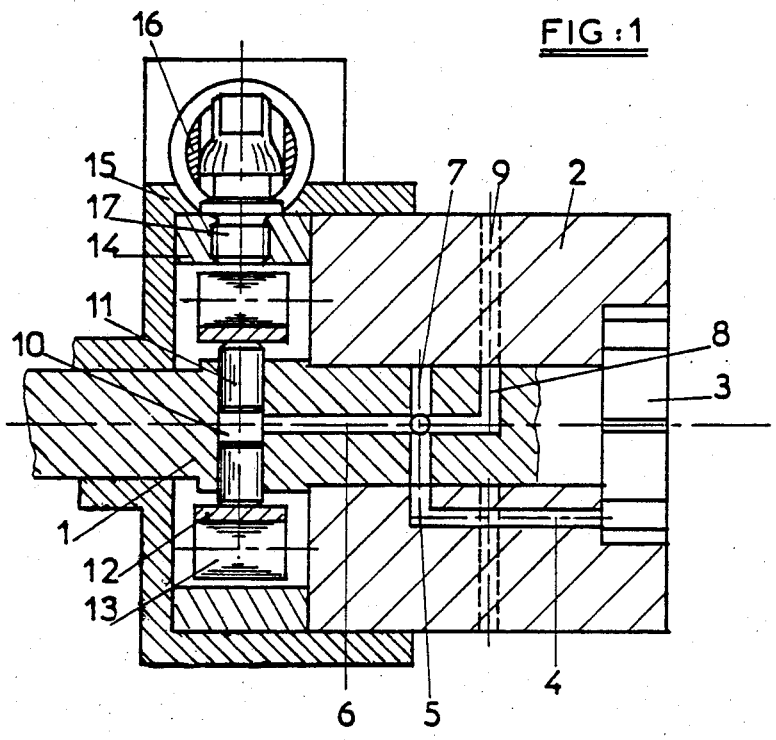
FIG. 1 is a diagrammatic axial section of the injection pump.

The fuel injection pump comprises a rotor 1 mounted in a fixed body 2 and driven in use synchronously with the engine which it is required to supply. The rotor 1 is coupled at one end to the rotary portion of a supply pump 3 whose outlet 4 is connected, by means of a metering device (not shown), to an inlet port 5 which opens onto the periphery of the rotor. The output pressure of the supply pump is regulated by a valve (not shown) so as to vary as a function of the engine speed.

The rotor 1 is provided with an axial passage 6 which communicates with a plurality of inlet ports 7 formed in the rotor and having a uniform angular spacing which are brought in turn into communication with the inlet port 5 as the rotor rotates. The passage 6 communicates, moreover, with an outlet passage 8 which opens onto the periphery of the rotor at a position to register successively with a plurality of outlets 9 formed in the fixed body 2 and connected to the injectors of the associated engine respectively.

The passage 6 communicates with a transverse bore 10 formed in the rotor and in which is located a pair of pistons 11 between which there is defined a pumping chamber.

The pistons 11 at their outer ends are engaged by roller supports 12 supporting rollers 13 respectively. A cam ring 14 surrounds the rotor and has on its internal periphery cam lobes with which the rollers 13 engage as the rotor rotates. This engagement causes the pistons 11 to be displaced inwardly and consequently fuel is forced from the pumping chamber and flows through an outlet passage 8 to one of the outlets 9.

The cam ring 14 may be angularly displaced about the axis of rotation of the rotor 1, and its angular position is controlled by a piston 16 engaging an arm 17 connected to the ring 14. The piston 16 is subject to the action of a control pressure which is derived from the output pressure of the supply pump 3 such that the position of the ring 14 is a function of the engine speed. This enables, as required, the beginning of injection to be brought forward as a function of increasing engine speed.

Figure 2:
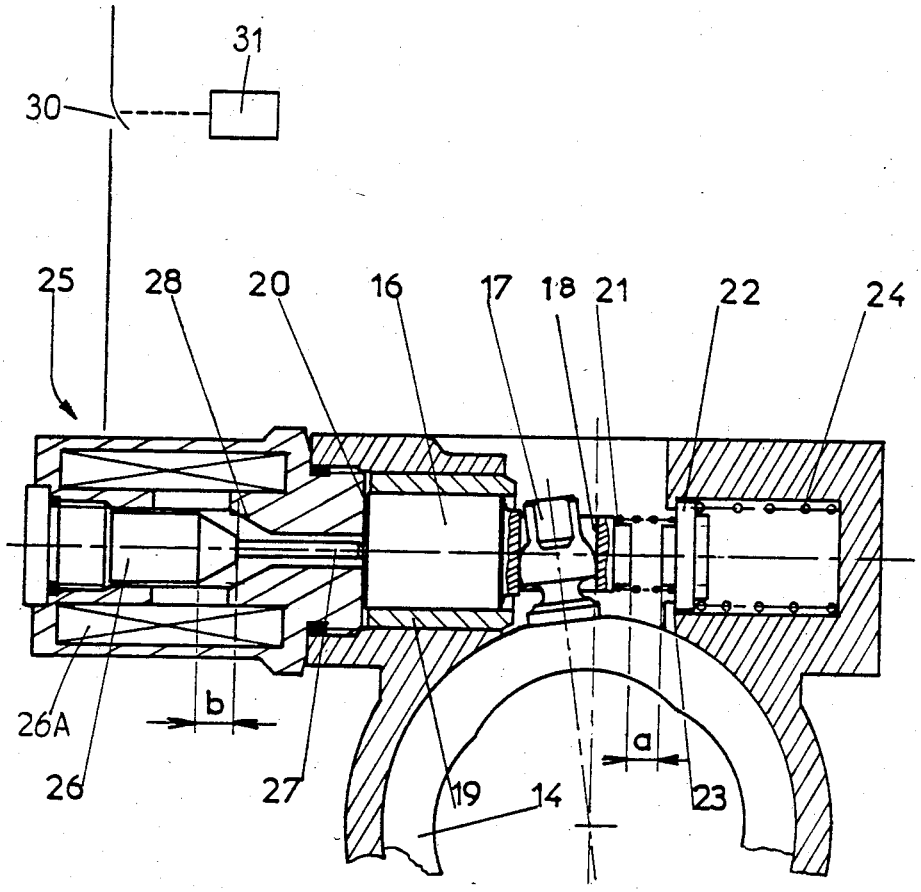
FIG. 2 is a cross-section of part of the pump seen in FIG. 1.

As shown in FIG. 2, the piston 16 is connected to the ring 14 by the arm 17 which is screwed into the cam ring and passes into a recess 18 provided in the piston 16. The piston 16 is slidable in a bore defined by a bushing 19 fixed in the pump body. The end face 20 of the piston is subject to the action of the control pressure which varies with the engine speed, the connection provided for this purpose including a valve (not shown) which prevents application of the control pressure until a speed is attained which is lower than the idling speed of the engine.

The opposite end of the piston 16 is engaged by one end of a spring 21 whose other end is in contact with a collar 22, the assembly being set up such that at rest there is a dimension "a" between the piston 16 and the collar 22. The collar 22 is urged against a stop 23 provided on the body, by a spring 24 whose other end is in contact with the body, the force exerted by the spring 24 being greater than the force exerted by the spring 21.

The arrangement described above is known from French Patent Specification No. 2299514.

In accordance with the invention, the pump also includes an electromagnetic device 25 mounted on the pump body.

The device 25 comprises an armature core 26 having an end 27 engageable with the piston 16 and which can apply a force or thrust to the piston in the same direction as the control pressure, when the electromagnet is supplied with electrical power. The maximum movement of the armature core is determined by its abutment with a pole face 2S and is represented in FIG. 2 by the dimension "b" which is always greater than the dimension "a". The device 25 includes a winding 26A.

Figure 3:
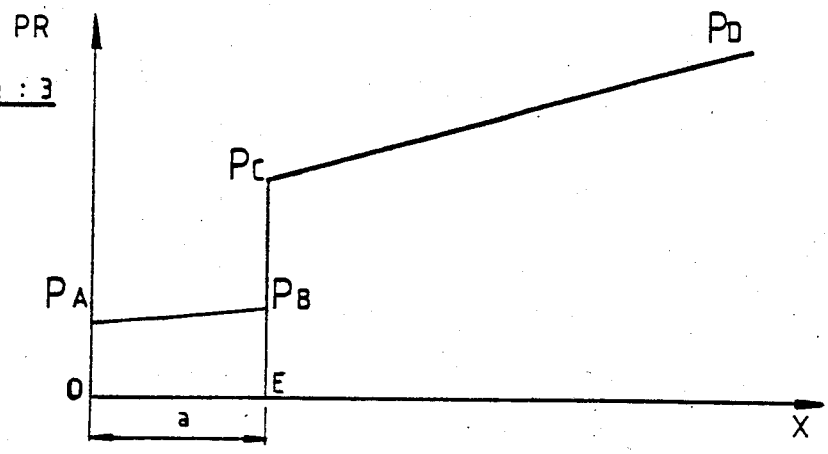
FIGS. 3 to 8 are diagrams explaining the operation of the pump.
Figure 4:
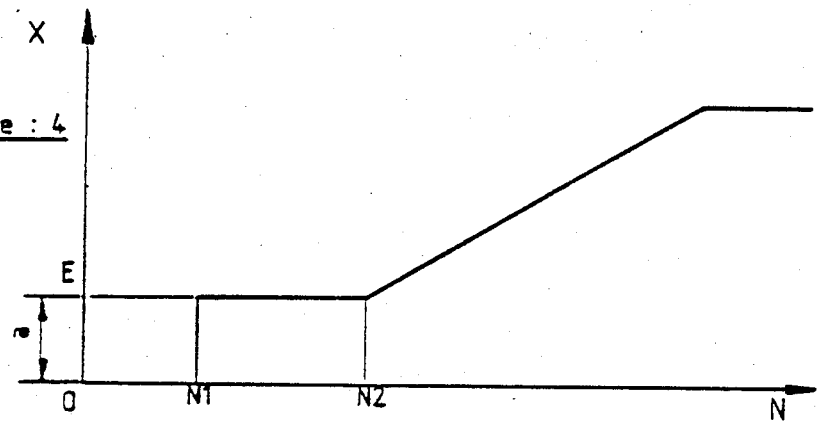

Ignoring for the moment, the electromagnetic device, FIG. 3 shows the curve of the control pressure PR required for the displacement X of the piston 16 against the resilient means 21 and 24. PA corresponds to the initial load of the spring 21, PC to the initial preload of the spring 24. The displacement OE corresponds to the distance "a" separating, in the rest condition, the piston 16 and the collar 22. In operation, the displacement characteristic of the piston 16 as a function of the speed of rotation N is shown in FIG. 4. Below the speed N1, when the aforesaid valve is closed, the control pressure is zero and the piston 16 occupies the position shown in FIG. 2. At the speed N1, the control valve opens to allow the control pressure to be applied to the piston 16, this pressure being greater than PA and PB, but lower than PC. The piston 16 then moves to compress the spring 21 and attains the position "E", i.e. the position in which the piston 16 and collar 22 are in contact. A further displacement is obtained above N2 as the control pressure increases above the value PC corresponding to the force exerted by the spring 24. The displacement OE or "a" corresponds to what is known as the automatic start delay.

Figure 5:
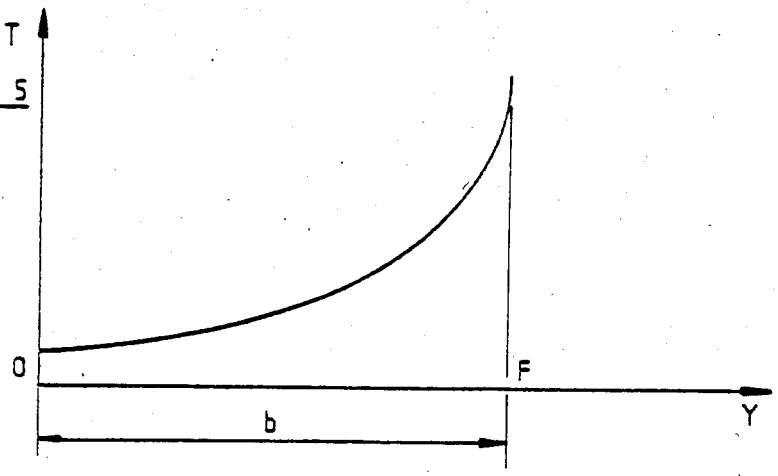

When the electromagnetic device is supplied with current, the thrust force T developed is inversely proportional to the air gap Y, i.e. the distance between the core and the stator. FIG. 5 shows the thrust curve of the core 26 as a function of the air gap, the thrust force reaching a maximum when the air gap is zero in position "F", the position "O" being the rest position.

Figure 6:
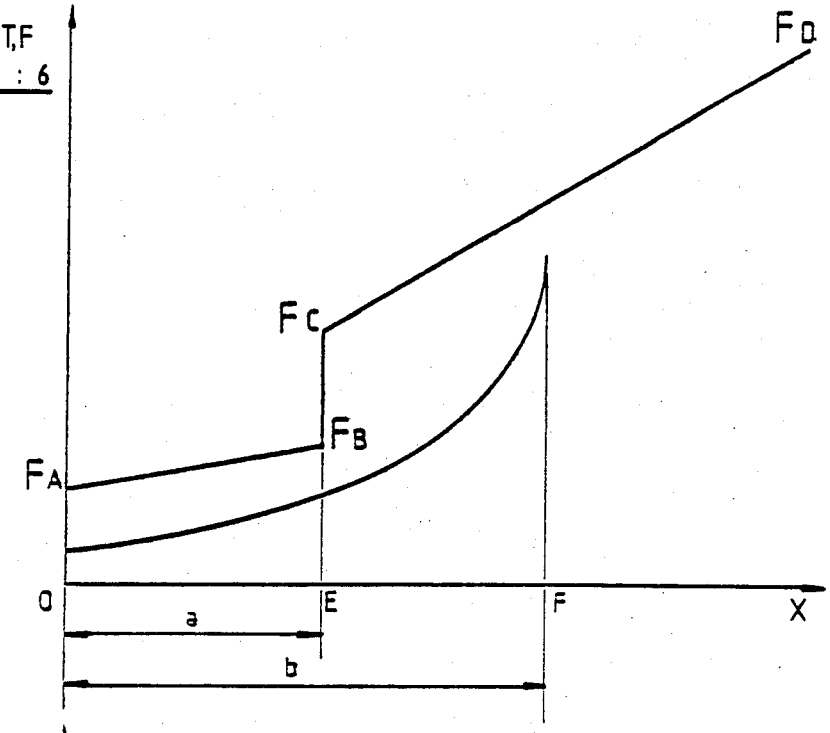

In operation, at engine cranking speed, the aforesaid valve is closed and the control pressure is not applied to the piston 16. In these conditions, the effort of the electromagnetic device is not sufficient to displace the piston 16 against the two springs 21 and 24. This case is shown in FIG. 6 in which the pressures PA, PB etc. have been converted into forces FA, FB etc.

Figure 7:
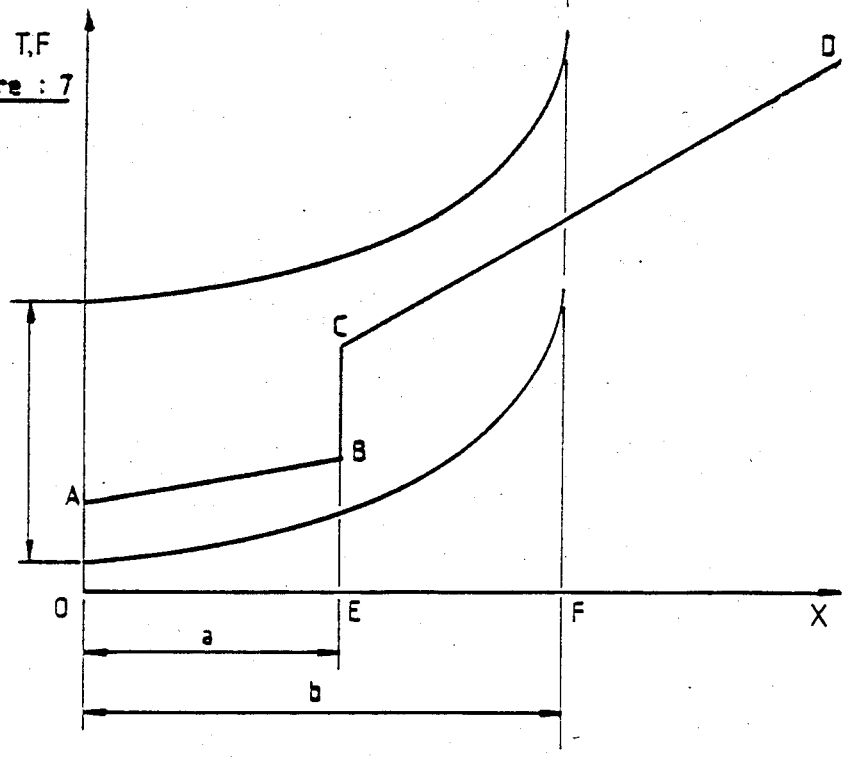

At the engine speed N1, and during engine idling NR, the control pressure PR is applied to the piston 16, the control pressure PR is greater than PB and lower than PC as set out above. In these conditions, as shown in FIG. 7, the combination of the force generated by the pressure PR and the effort of the electromagnetic device is greater than the effort required to overcome the springs 21 and 24. The advance piston 16 is positioned at the point "F" corresponding to the abutment of the core 26 against the stop.

Figure 8:
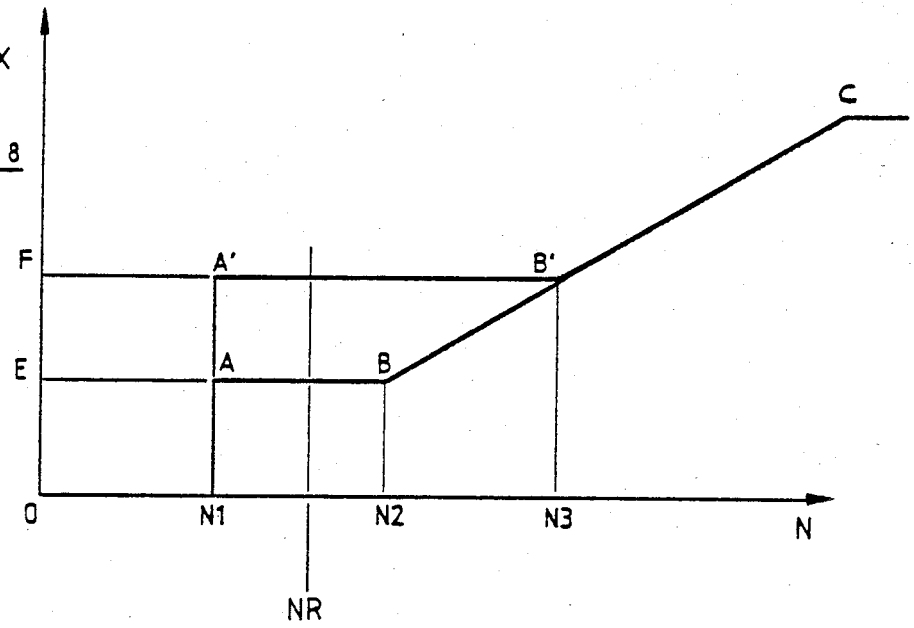

FIG. 8 shows the displacement characteristic of the piston 16 as a function of the speed of rotation of the engine. When the electromagnet is not being supplied with electric current, the characteristic O—N-1—A—B—C is obtained and is the same as that shown in FIG. 4. When the electromagnet is supplied with current the characteristic becomes O—N1—A'—B-'—C. In effect, beyond the displacement "F", the electromagnetic device exerts no further thrust as the core 26 reaches its stop and it is then necessary to wait for the speed N3 at which the control pressure itself becomes sufficient to further compress the spring 24, before further movement of the piston can take place. NR corresponds to the idling speed of the engine.

With the pump according to the invention it is possible, at a given low engine speed, and particularly at the engine idling speed, to modify the timing of fuel delivery by supplying, or by not supplying, the electromagnetic device with current whilst retaining for starting purposes, the required timing of fuel delivery whether or not the electromagnet is energised.

The electromagnetic device may be controlled automatically.

A first application uses the characteristic A'-B' of FIG. 8 when the engine is cold, the discontinuation of the current supply to the electromagnetic device taking place when the engine is hot by means either of an electrical switch 30 controlled by a thermostat 31, or by a switch formed by a positive temperature coefficient (PTC) resistor.

The thermostat may incorporate a control element formed from an expandable material such as wax, or by a bimetallic washer or washers, or by a material with form memory such as a temperature responsive spring.

The control of the supply of current to the electromagnetic device may also be carried out by a timing device which ensures the supply of current for a given period of time after the engine has started, during which time the engine attains its working temperature.

The control of the current supply to the electromagnetic device may also be provided by its connection to a "post-heating" device, which device is designed to keep the engine heater devices which normally facilitate engine starting, energised for a certain period of time after starting. This "post-heating" provides more satisfactory operation of the engine when it is cold and it may also be advisable to change the timing of fuel delivery under these conditions.

A second application uses the characteristic A'-B' or A-B as a function of the load on the engine by controlling the current flowing in the electromagnetic device either as a function of the position of the vehicle throttle control, or of the position of the flow metering device of the injection pump. The position of the throttle control or the metering device may be detected either by contact switches, or by proximity or displacement sensors.

I claim:

1. A fuel injection pump for supplying fuel to an internal combustion engine in particular a compression ignition engine, comprising a high pressure pump which is actuated in timed relationship in use, with the associated engine, a distributor rotor which rotates in a fixed body and which distributes fuel delivered by the high pressure pump to outlets in turn, the outlets in use being connected to the injection nozzles of the engine respectively, a component in the high pressure pump which is adjustable to vary the timing of delivery of fuel, a fluid pressure operable piston, means coupling said piston to said component, means for supplying to one end of said piston a fluid control pressure which varies in accordance with an engine operating parameter, a first compression spring acting between the other end of said piston and a collar, a stop for the collar and a second compression spring acting to urge said collar into contact with said stop, whereby as the control pressure increases, the piston will move firstly against the action of said first spring through a predetermined distance until the piston engages said collar and after a further increase in the control pressure will move against the action of said second spring, characterised by an electromagnetic device including a core which when electric current is supplied to the device imparts a thrust on said one end of the piston in opposition to the force exerted by said springs, the working stroke of said core being greater than said predetermined distance, the characteristics of said device being such that in the absence of said fluid control pressure the core is unable to move the piston against the action of said first spring but when the fluid control pressure rises to a value at which movement of the piston against the action of the first spring can occur, the combined action of the fluid control pressure and the thrust exerted by the core moves the piston through a distance represented by the working stroke of the core.

2. A pump as claimed in claim 1, in which the control of the electromagnetic device is carried out as a function of the engine temperature, in which the detection of the temperature of the engine may either be carried out by expandable materials such as wax, or by bimetallic washers, or by materials with form memory, or by electronic components sensitive to temperature.

3. A pump as claimed in claim 1, in which the control of the electromagnetic device is carried out as a function of the engine load, either by the detection of the throttle position, or by the detection of the position of a fuel metering device forming part of the pump.

4. A pump as claimed in claim 1, in which the control of the electromagnetic device is carried out by a timing device which is triggered when the engine is started.

5. A pump as claimed in claim 1, in which the control of the electromagnetic device is ensured by a control device which controls the operation of the engine heating devices and which maintains the heating devices and the electromagnetic device energised after the engine has started.

* * * * *